US006899588B1

(12) United States Patent
Clever et al.

(10) Patent No.: US 6,899,588 B1
(45) Date of Patent: May 31, 2005

(54) HERMAPHRODITIC (GENDERLESS) CONSTRUCTION SYSTEM

(76) Inventors: Eric Clever, 29 Estaugh Ave., Haddonfield, NJ (US) 08033; Ray Lyons, 29 Estaugh Ave., Haddonfield, NJ (US) 08033

( * ) Notice: Subject to any disclaimer, the term of this patent is extended or adjusted under 35 U.S.C. 154(b) by 779 days.

(21) Appl. No.: 09/188,702

(22) Filed: Aug. 13, 1998

Related U.S. Application Data

(60) Provisional application No. 60/055,282, filed on Aug. 13, 1997.

(51) Int. Cl.[7] ..... A63H 33/04
(52) U.S. Cl. ..... 446/120; 446/126
(58) Field of Search ..... 446/114, 116, 446/120, 121, 125, 124, 126

(56) References Cited

U.S. PATENT DOCUMENTS

| | | | | |
|---|---|---|---|---|
| 2,709,318 A | | 5/1955 | Benjamin | |
| D213,709 S | | 4/1969 | Gale | D34/15 |
| 3,597,874 A | | 8/1971 | Ogsbury et al. | |
| 3,603,025 A | | 9/1971 | Heubl | |
| 3,699,709 A | * | 10/1972 | Schmidt | 446/126 |
| 4,758,196 A | * | 7/1988 | Wang | 446/120 |
| 4,789,370 A | * | 12/1988 | Ellefson | 446/114 |
| D304,217 S | | 10/1989 | Klitsner | D21/108 |
| 4,902,259 A | | 2/1990 | Ziegler | 446/117 |
| 5,137,486 A | | 8/1992 | Glickman | 446/126 |
| 5,183,409 A | * | 2/1993 | Clever et al. | |
| 5,350,331 A | * | 9/1994 | Glickman | 446/126 |
| 5,378,185 A | * | 1/1995 | Ban | 446/120 |
| 5,871,384 A | * | 2/1999 | Kichijo | 446/120 |
| 5,910,038 A | * | 6/1999 | Zheng | 446/114 |

FOREIGN PATENT DOCUMENTS

| | | | | |
|---|---|---|---|---|
| DE | 1236621 | * | 3/1967 | 446/120 |
| DE | 2 033 435 | | 2/1972 | |
| EP | 476 955 | | 3/1992 | |
| FR | 1183331 | * | 7/1959 | 446/125 |
| GB | 999743 | * | 7/1965 | 446/125 |

* cited by examiner

*Primary Examiner*—Kien Nguyen
(74) *Attorney, Agent, or Firm*—Norman E. Lehrer

(57) ABSTRACT

Disclosed are improvements to a construction system based on genderless connectors. The improvements consist of chamfered entries to permit greater ease of connection and a suite of female connectors that extend the capabilities of the basic genderless connectors on which the construction system is based.

9 Claims, 3 Drawing Sheets

HERMAPHRODITIC (GENDERLESS) CONSTRUCTION SYSTEM

CROSS REFERENCE TO RELATED APPLICATION

This application claims the benefit of U.S. Provisional Patent Application Ser. No. 60/055,282, filed Aug. 13, 1997.

BACKGROUND OF THE INVENTION

This invention relates to construction toy systems. More particularly it relates to both hub and rod construction toy systems based on hermaphroditic and identical (genderless) connectors, and to building block systems also based on genderless connectors. In many cases the genderless connectors are integral to the parts being connected. These genderless connectors greatly extend the range of applications for this invention. In particular we disclose improvements to such construction systems that greatly facilitate connection perpendicular to the usual plane of connection for such systems. Said improvements can be characterized as female connectors that accommodate said genderless connectors—effectively converting them to male connectors.

This is a crowded art with much activity in the construction toy system part of it, with many U.S. patents, referred to by number below, known to the inventor which have some pertinence. U.S. Pat. No. 1,113,371 discloses the original rod and hub construction toy system with wooden hubs and rods and with the rod inserted into a hole in the hub and held there by friction and compression (interference fit). U.S. Pat. No. 1,707,691 discloses a hub and rod construction toy system with a hub of stamped metal and wooden rods with slit ends. The connection is formed by inserting the metal hub into the rod-end slit. A great many construction toy systems allow identical elements to be interconnected but with only a few exceptions noted below the actual connections are not genderless. Instead, the male and female connecting elements are placed on opposite ends of the block or hub. In any event, we found no construction system that allowed genderless connection between non-identical elements, e.g., between hub and rod. U.S. Pat. No. 3,626,632 discloses a typical building block system that allows identical blocks to be interconnected by means of a male element on one side and female elements on three other sides. But U.S. Pat. No. 2,800,743 discloses a nearly genderless building block system. But in this system when genderless connections are made the elements are no longer aligned and regular figures can not be constructed.

U.S. Pat. No. 2,633,662 discloses a construction toy system with genderless interconnection for hubs connected orthogonally. But hub and rod connections in the same plane are effected with rods that connect across the face of the hubs and do not form a genderless connection. U.S. Pat. No. 4,758,196 discloses a hub and rod construction toy system with genderless rod—rod connections but without any way of directly connecting the hubs.

Various concepts from the construction and other industries have been adapted to construction toy systems. U.S. Pat. No. 3,648,404 discloses a hub and rod construction system designed to be used with hollow rods. The construction toy system disclosed in U.S. Pat. Nos. 4,078,328 and 5,049,105 uses a similar connection system. U.S. Pat. No. 3,891,335 discloses a hub and rod and panel snap together construction system. The hub and rod construction toy system disclosed in U.S. Pat. Nos. 5,061,219, 5,137,486 and 5,199,919 uses a retaining clip similar to the one disclosed in the 335 patent. The 486 patent does disclose a genderless hub—hub connection for orthogonally connecting hubs. However, the means of connecting the hubs is not the same means as connecting rods to hubs.

Other mechanical connectors include U.S. Pat. No. 4,280,339, which discloses a torque transfer device for flexible shaft couplings. Each shaft has an extended portion with forked ends defining teeth. The teeth are inserted orthogonally to each other. U.S. Pat. No. 3,800,556 discloses a power shaft coupling including a coupling mechanism having elongate square bars defining extensions. These extensions may be mutually inserted in orthogonal positional relationship. U.S. Pat. No. 2,577,508 is a universal coupling with bifurcated tongues that mate. U.S. Pat. No. 2,832,943 is a detachable coupling in which the male and female members are not identical but do have an orthogonal insert relationship. U.S. Pat. No. 3,224,222 is a universal joint with yoke members including cross-pintles for connecting the yoke members together.

Hermaphroditic connectors have been used in the electronic connector industry. The invention disclosed herein grew out of our prior electronic connector inventions. See Clever and Lyons U.S. Pat. No. 5,183,409 and continuation in part application Aug. 1, 1994.

Other presently known U.S. patents having interest are: U.S. Pat. Nos. 3,516,043; 3,070,769; 2,690,542; 3,011,143; 4,199,208; 3,634,811; 2,996,026; 3,070,769; 2,475,046; 2,470,282; 1,865,300; 2,577,508; 607,607; 3,552,145; 1,171,380; 2,740,271; 4,172,369; 2,460,231; 534,732, and 2,389,115. It is believed that the present invention is patentably distinct from the teachings of any of the above-cited patents.

SUMMARY OF THE INVENTION

We disclose improvements to the construction toy systems disclosed in our copending related application Ser. No. 08/862,948 filed May 30, 1997 which describes toy systems all of whose parts directly interconnect by means of genderless connectors. The entire subject matter of said prior application being incorporated herein by reference. The improvements include: the use of the genderless connectors as either male or female connectors, a female connector that can be used with the genderless connectors, chamfered fingers to improve the ease of connection.

By the use of these genderless connectors plus the disclosed improvements a very wide range of very different and independent toy systems can be designed that freely interconnect. In fact, the invention disclosed in the related application with the addition of the improvements disclosed in this application allows for the creation of a near universal construction toy system—one that allows for free interconnection across a wide range of construction toy types: hub-and-rod, beam-and-bearn, blocks, and geodesics all in a range of sizes that makes them appropriate for various age groups from toddler (very large and easy to grasp) to adult (miniature, precision) with all the pieces from all the sizes and types interconnecting.

BRIEF DESCRIPTION OF THE FIGURES

For the purpose of illustrating the invention, there are shown in the accompanying drawings forms which are presently preferred; it being understood that the invention is not intended to be limited to the precise arrangements and instrumentalities shown.

DESCRIPTION OF THE PREFERRED EMBODIMENTS

Figure 1:
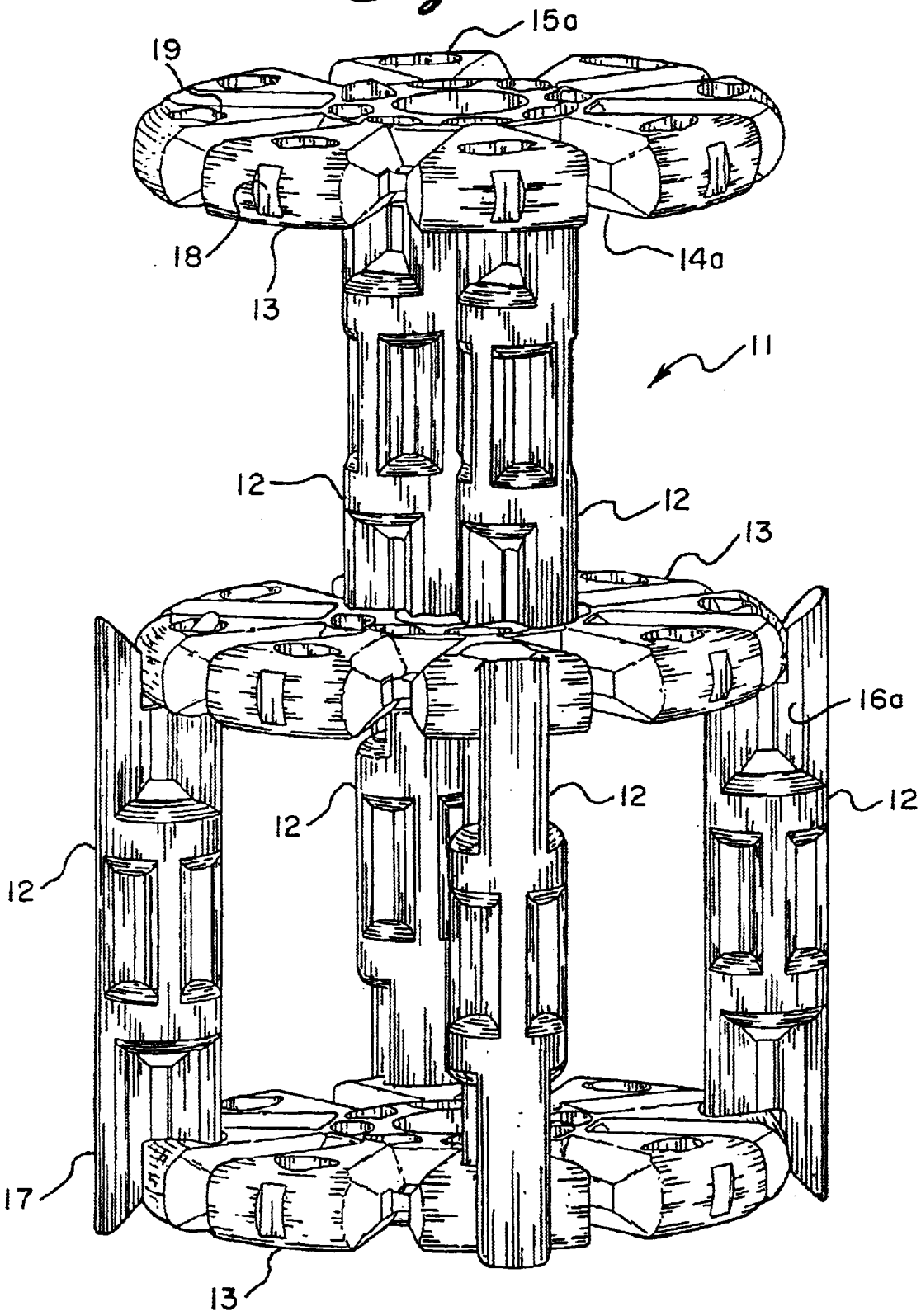
FIG. 1 shows in perspective view a rod and hub assembly that uses the female vertical connector.

Disclosed are improvements to the inventions disclosed in the related application. The disclosures include chamfered or filleted entries on the basic type 1 genderless connectors to improve ease of assembly of the hubs and rods. Also disclosed are 'vertical' connectors that are female connectors that mate with genderless type 1 connectors and allow for connection of rods to hubs or of rods to blocks that would not otherwise be available. As in the basic type connector these other connectors—types 2 through 6—rely on a slight interference fit to hold (as is disclosed in the related application). Also disclosed is an 'adapter block' that allows rods of genderless construction systems to mate with traditional block systems. These block systems rely on an interference fit between vertically extruded bosses. We adapt the 'down bosses' in our adapter block with a vertical female type 6 connector.

Said vertical connectors are the negative of type 1 genderless connectors. Which is to say that they can be modeled by Boolean operations on solids by subtracting a type 1 connector from a solid. If only the slot end of the type 1 connector is used for the subtraction then connectors of type 3 and type 4 are produced. If the web end is used for the subtraction then type 2, type 5 and type 6 connectors are produced. In an optimally designed vertical female connector the surfaces of connection to a type 1 connector are the x-bearing surfaces. However, vertical female connectors type 4 and type 6 must also use the web-bearing surface of the finger not inserted as a surface of connection. These types are used when space is limited and there is not enough room for both halves of a vertical female connector.

The chamfer or filleted entries on the type 1 connectors ease the angle of entry from 90°.

DETAILED DESCRIPTION OF THE DRAWINGS

Figure 3:
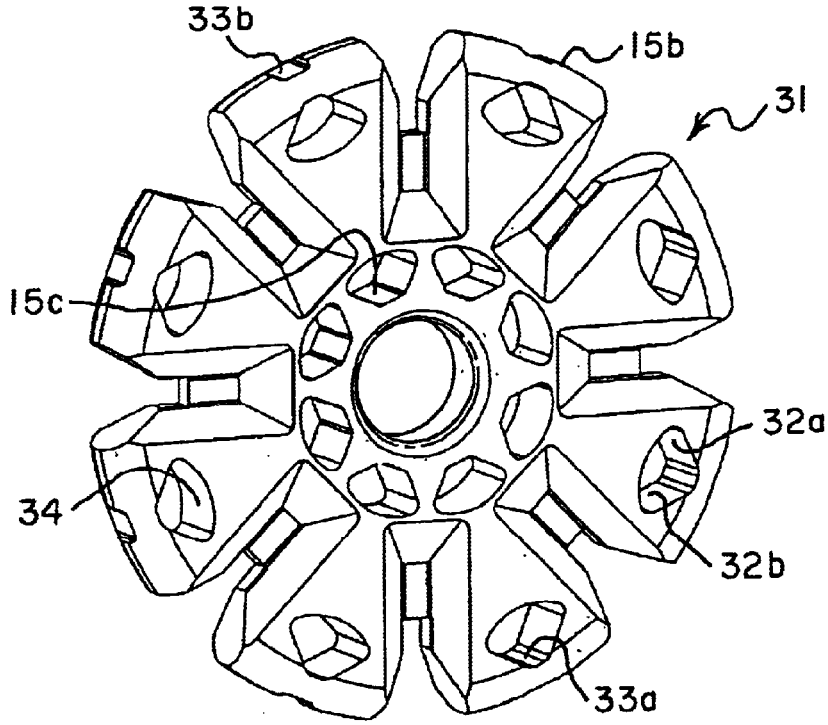
FIG. 3 shows in perspective view a hub with another form of the female vertical connector—type 4.

We disclose inventions that aid in the construction of complex hub, rod, and block assemblies in which rods are inserted perpendicular to the major plane of said hubs and blocks. These inventions are improvements to hub, rod and block construction systems in which the major plane of connection is parallel to the major plane of the part. In FIG. 1 we show an assembly 11 of six rods, all effectively identical to rod 12, and three hubs, all effectively identical to hub 13. Connection is effected by means of type 1 connectors on rods, all effectively identical to connector 14*a* on rod 12, and by type 4 connectors on hubs, all effectively identical to connector 15*a* in FIG. 1 and 15*b* . . . *c* in FIG. 3. (Note that connector 14*b* on hub 13 is functionally identical to connector 14*a*.). FIG. 3 shows a hub 31 identical in function to hub 13 where it is shown in near plan view for clarity.

Connection is achieved when a rod's type 1 connector is inserted into a type 4 connector, such as 15*b*, in such a way that its x-bearing surfaces 16*a* and 16*b* on its finger 17*a* slide past x-bearing surfaces 32*a* and 32*b* and its web-bearing surface 18*b* on finger 17*b* slides past web-bearing surface 33. Note that it is neither necessary nor usually desirable for a rod finger back surface 19 to contact a vertical female back surface 34.

Figure 2:
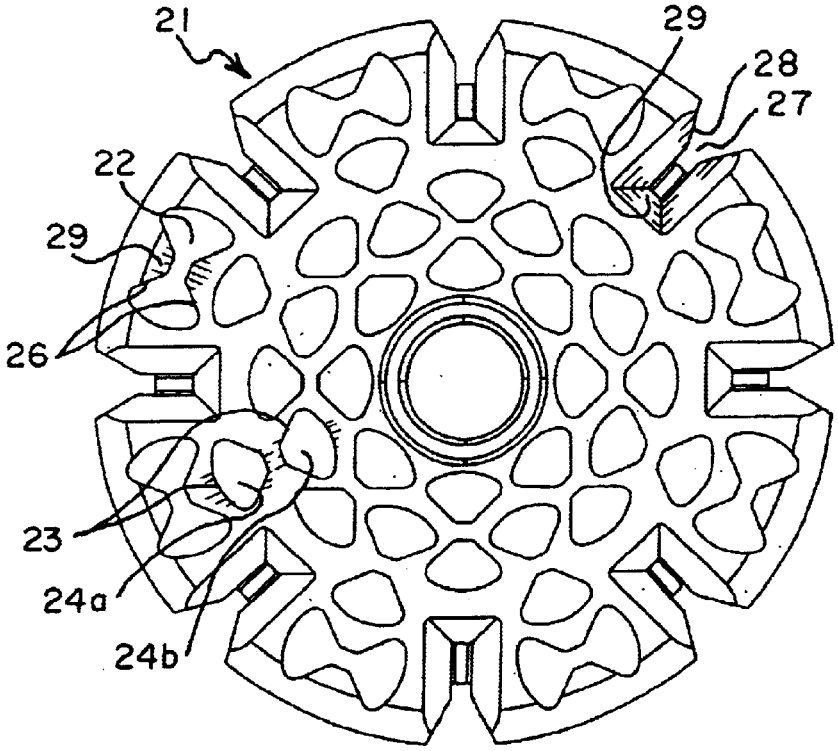
FIG. 2 shows in plan view a hub with two forms of the female vertical connector—type 2 and type 3 connectors—type 1 is the basic type genderless.

In FIG. 2 we show in plan view a hub 21 with vertical female connectors distributed in a polar array with their principal axis perpendicular to the hub's main axis. These vertical female connectors consist of type 2 connectors all identical to 22, and type 3 connectors all identical to 23. Said connector 23 is constructed of two identical halves 24*a* and 24*b*. The separation between the two halves effectively creates a web 25 which acts as a stop to the insertion of a type 1 connector which cannot be inserted past its own web 10. On the other hand, type 2 connector 22 lacks such an obstruction and a rod with the same profile can pass all the way through with only the interference fit of the x-bearing surfaces 26 resisting its passage.

Also are shown eight type 1 connectors all identical to connector 27 with chamfered or filleted entries 28 and backfills 29. When inserting a rod, web faces 71 and 72 touch before the chamfer tip 28 touches the backfill 29.

Figure 5:
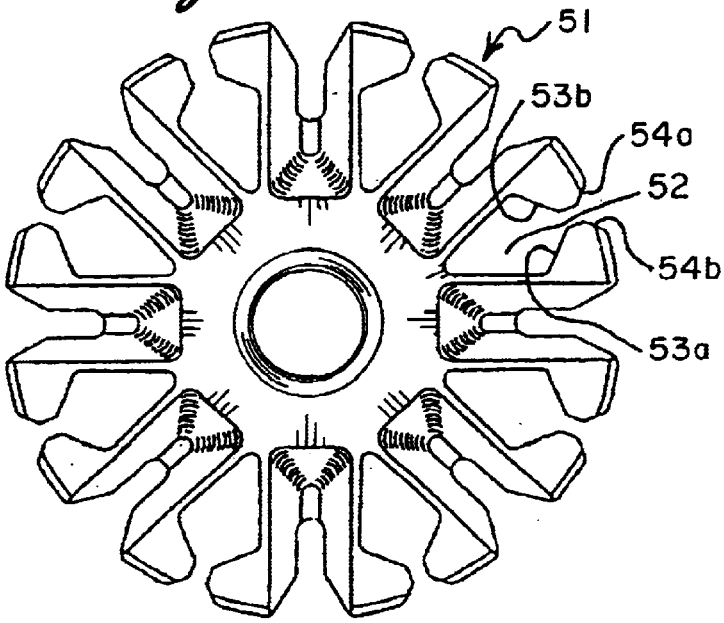
FIG. 5 shows in plan view a hub with another form of the vertical female connector—type 5.

In FIG. 5 a hub 51 is furnished with type 5 connectors all identical to 52. Said connectors lack web and web faces. Interference fit is achieved at x-bearing surfaces 53*a* and 53*b* and abbreviated x-bearing surfaces 54*a* and 54*b*.

Figure 4A:
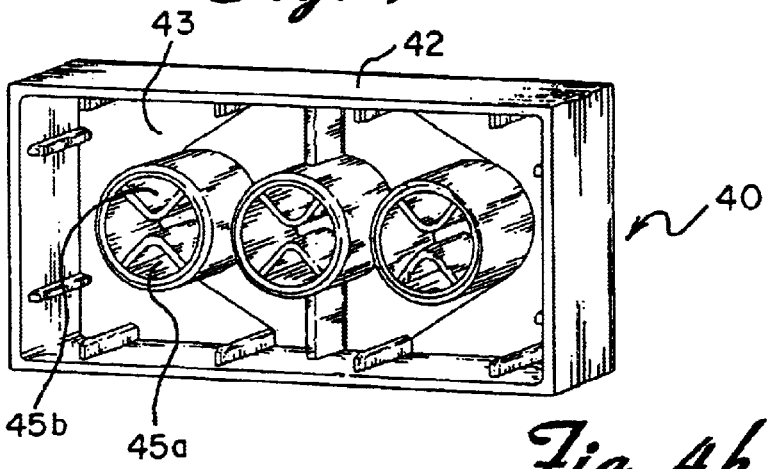
FIG. 4*a* shows a bottom perspective view of an elongated connector—type 6—that is part of an adapter block.
Figure 4B:
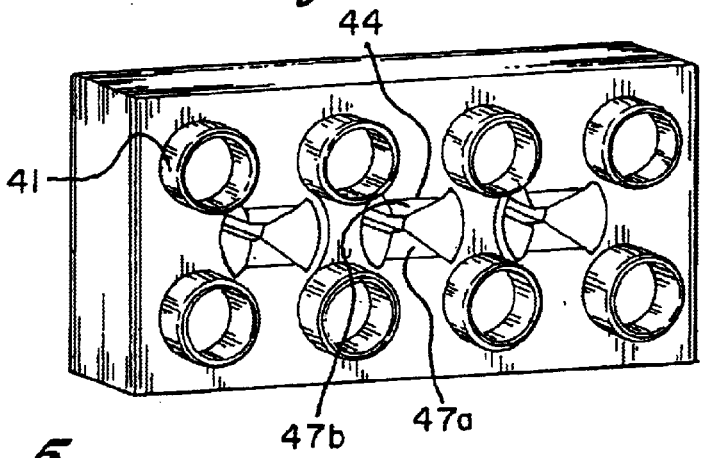
FIG. 4*b* shows a top perspective view of an elongated connector—type 6 that is part of an adapter block.

In FIG. 4*b* we show an adapter block with vertically extruded hollow bosses 41 on the top. The block is a hollow rectangle open at the bottom.

In FIG. 4*a* we show a hollow rectangle adapter block 40 open at the bottom. When one block is placed on top of another, said top bosses 41 mate, by means of an interference fit, with vertically extruded hollow down bosses 42 placed in block 40's hollow bottom 43. Vertical female connectors identical to 44 are placed within down bosses 42. Said connectors 44 consist of two hollow fingers 45*a* and 45*b* attached to the wall 46 of said connector. Said fingers 45*a* and 45*b* can optionally be filled at the top and furnished with chamfered tips 47*a* and 47*b*. Connection is achieved to a rod furnished with type 1 connectors by means of an interference fit at x-bearing connecting surfaces 48*a* . . . *d* when said rod is inserted and its x-bearing surfaces slide past 48*a* . . . *d* with an interference fit.

The present invention may be embodied in other specific forms without departing from the spirit or essential attributes thereof and accordingly, reference should be made to the appended claims rather than to the foregoing specification as indicating the scope of the invention.

We claim:

1. Female connectors and genderless rods for use with a genderless construction system wherein each female connector is comprised of a substantially round disc shaped plastic member having two holes formed therein and wherein each genderless rod includes two substantially identical spaced apart fingers; said female connector being adapted to mate with said two-fingered genderless rod by means of an interference fit when the fingers are inserted into the holes, at least one of said holes being substantially triangularly shaped and including three internal angular corners, one of said corners of said at least one hole being closer to the other of said two holes than the other two of said three corners.

2. The female connectors and genderless rods as claimed in claim 1 wherein said holes are distinct from each other and a web of material is included separating said holes from each other.

3. The female connectors and genderless rods as claimed in claim 1 wherein said holes are inter-connected to each other by a narrow passage extending between said holes.

4. The female connectors and genderless rods as claimed in claim 1 wherein each of said holes is substantially triangularly shaped and includes three internal angular corners therein.

5. The female connectors and genderless rods as claimed in claim 4 wherein one of the angular corners of each of said holes are in alignment with each other.

6. The female connectors and genderless rods as claimed in claim 5 wherein said holes are distinct from each other and a web of material is included separating said holes from each other.

7. The female connectors and genderless rods as claimed in claim 5 wherein said holes are inter-connected to each other by a narrow passage extending between said holes.

8. Female connectors for use with a genderless construction system wherein each female connector is comprised of a substantially round disc shaped plastic member having two holes formed therein and adapted to mate with a two-fingered genderless connector by means of an interference fit when the fingers are inserted into the holes, at least one of said holes being substantially triangularly shaped and including three internal angular corners, one of said corners of said at least one hole being closer to the other of said two holes than the other two of said three corners, and said holes being inter-connected to each other by a narrow passage extending between said holes.

9. Female connectors for use with a genderless construction system wherein each female connector is comprised of a substantially round disc shaped plastic member having two holes formed therein and adapted to mate with a two-fingered genderless connector by means of an interference fit when the fingers are inserted into the holes, each of said holes being substantially shaped and including three internal angular corners therein, one of said corners of said at least one hole being closer to the other of said two holes than the other two of said three corners, one of the angular corners of each of said holes being in alignment with each other, and said holes being inter-connected to each other by a narrow passage extending between said holes.

* * * * *